US006086691A

United States Patent [19]

Lehockey et al.

[11] Patent Number: 6,086,691

[45] Date of Patent: Jul. 11, 2000

[54] METALLURGICAL PROCESS FOR MANUFACTURING ELECTROWINNING LEAD ALLOY ELECTRODES

[76] Inventors: Edward M. Lehockey, 533 Golden Oak Drive, Oakville, Ontario, Canada, L6H 3X6; Gino Palumbo, 9 Tyler Place, Etobicoke, Ontario, Canada, M9R 1L8; Peter Keng-Yu Lin, 20 Lebos Road, North York, Ontario, Canada, M2H 2L9; David L. Limoges, 85 Murrine Street, Etobicoke, Ontario, Canada, M8V 1X6

[21] Appl. No.: 09/127,715

[22] Filed: Aug. 3, 1998

Related U.S. Application Data

[60] Provisional application No. 60/054,680, Aug. 4, 1997.

[51] Int. Cl.[7] ..... C22F 1/12

[52] U.S. Cl. ..... 148/706; 204/293; 420/563; 420/564; 420/565; 420/566; 420/570; 429/226

[58] Field of Search ..... 148/706; 420/563, 420/564, 565, 566, 570; 204/293; 429/226

[56] References Cited

U.S. PATENT DOCUMENTS

| | | | |
|---|---|---|---|
| 3,953,244 | 4/1976 | Prengaman | 148/706 |
| 4,050,961 | 9/1977 | Knight | 420/565 |
| 4,517,065 | 5/1985 | Guerriero | 204/293 |
| 4,725,404 | 2/1988 | Reif et al. | 420/565 |

FOREIGN PATENT DOCUMENTS

| | | |
|---|---|---|
| 0 795 917 | 9/1997 | European Pat. Off. . |
| 2 027 627 | 2/1980 | United Kingdom . |
| WO 94 14986 | 7/1994 | WIPO . |

OTHER PUBLICATIONS

E.M. Lehockey, et al., Mat. Res. Soc. Symp. Proc. vol. 458 1997 Materials Research Society, pp. 243–248, "Grain Boundary Engineered Lead Alloys".

R.D. Prengaman, "New Lead Based Anodes for Electrowinning", edited proceedings of 9th International Lead Conference, pp. 47–53, (1986).

R. David Prengaman, "Wrought Lead–Calcium–Tin Anodes for Electrowinning" in Anodes for Electrowinning: Proceedings of the Sessions, 1984, pp. 59–67.

R. David Prengaman, "New Insoluble Lead Anodes for Copper Electrowinning", Proceedings of the Electro refining and Winning of Copper Conference, 1987, pp. 457–467.

*Primary Examiner*—Bruce F. Bell
*Attorney, Agent, or Firm*—Ridout & Maybee

[57] ABSTRACT

Lead and lead-alloy anodes for electrowinning metals such as zinc, copper, lead, tin, nickel and manganese from sulfuric acid solutions, whereby the electrodes are processed by a repetitive sequence of cold deformation and recrystallization heat treatment, within specified limits of deformation, temperature and annealing time, to achieve an improved microstructure consisting of a high frequency of special low Σ CSL grain boundaries (i.e.>50%). The resultant electrodes possess significantly improved resistance to intergranular corrosion, and yield (1) extended service life, (2) the potential for reduction in electrode thickness with a commensurate increase in the number of electrodes per electrowinning cell, and (3) the opportunity to extract higher purity metal product.

3 Claims, 3 Drawing Sheets

GBE

··· Random Boundaries ▬ Special Boundaries (a)

(b)

METALLURGICAL PROCESS FOR MANUFACTURING ELECTROWINNING LEAD ALLOY ELECTRODES

RELATED INVENTION

This application replaces Provisional Patent Application No. 60/054,680 from which it derives the benefit of a filing date of Aug. 4, 1997.

FIELD OF THE INVENTION

This invention relates to a metallurgical manufacturing process for producing corrosion-resistant Pb and Pb-alloy electrodes used in the electrowinning of metals such as: Cu, Zn, Pb, Sn, Ni, and Mn from sulfuric acid solutions.

BACKGROUND OF THE INVENTION

Lead and lead-alloy (positive) electrodes, are used extensively in the electrowinning of copper, zinc, manganese, nickel and other metals from sulfuric acid solutions. The use of lead and lead-alloys in such applications is based upon their general ability to withstand prolonged exposure to sulfuric acid under highly oxidizing conditions. Lead and lead-alloy electrodes, usually in the form of cast plates as described in U.S. Pat. No. 4,124,482, and typically containing alloying constituents such as Ag, Ca, Sn and Sb, are expected to endure periods of up to 4 years under such harsh acidic conditions. The degradation of these electrodes is primarily due to intergranular corrosion, which occurs as a result of local volumetric changes associated with lead-sulfuric to lead-oxide transitions at the intersection of internal grain boundaries with the free surface of the electrodes. This results in a local compromise of the protective lead-oxide film, and subsequent propagation of corrosive attack into the grain boundaries, and ultimately, general loss of electrode metal via spalling and grain dropping. Such loss of electrode material, in addition to compromising the structural integrity of the electrode, results in contamination of the electrolyte by lead and other electrode alloying constituents, which ultimately limits the purity of the metal deposit which can be achieved during the electrowinning process.

Numerous studies have shown that certain 'special' grain boundaries, described on the basis of the well-established 'Coincidence Site Lattice' model of interface structure (Kronberg and Wilson, 1949[1] as lying within $\gamma\theta$ of $\Sigma$ where $\Sigma$£29 and $\gamma\theta$£15$\Sigma^{-1/2}$ (Brandon, 1966)[1] are highly resistant to intergranular degradation processes such as corrosion and cracking. In a previous U.S. patent (Palumbo, 1997)[3], a thermomechanical process is disclosed for increasing the population of such special grain boundaries in commercial austenitic Fe and Ni-based stainless alloys from approximately 20%–30% to levels in excess of 60%; such an increase resulting in significantly improved resistance to intergranular degradation processes such as intergranular corrosion and stress corrosion cracking. In more recent patent applications (Palumbo, Lehockey, and Brennenstuhl) [4], thermomechanical processes are disclosed for achieving such improvements with lead alloys commonly used as electrodes in conventional lead-acid batteries. The patents, applications and publications discussed above and identified by footnotes are incorporated by reference herein, for their disclosures on alloy interfacial structure.

SUMMARY OF THE INVENTION

According to the present invention, Pb- and Pb-alloy electrowinning electrode materials having special grain boundary populations in excess of 50% can be prepared. Such materials are processed from starting cast ingots or wrought starting stock, by specific repetitive cycles of deformation (rolling, pressing, extruding, stamping, drawing etc.) and recrystallization heat treatment. Use of these materials in electrodes affords significantly improved intergranular corrosion resistance in sulfuric acid-based electrowinning solutions.

[1] Kronberg, and Wilson. Trans. Met. Soc. AIME, 185 501 (1949).

[2] Brandon, Acta Metall., 14, 1479 (1966).

[3] Palumbo, G., U.S. Pat. No. 5,702,543 (1997)

[4] G. Palumbo, E. M. Lehockey and A. M. Brennenstuhl, U.S. patent application Ser. Nos. 08/609,326; 08,/609,327.

These improved electrode materials can provide enhanced reliability and extended service life, allow the use of reduced electrode thickness, and reduce the risk of impurity contamination of the electrolyte and metal product.

DETAILED DESCRIPTION OF THE INVENTION

The anode of the present invention comprises Pb or Pb-alloy containing Ag, Ca, Sn, Sb or any combination thereof suitable for use in electrowinning. These electrodes are in the form of sheet, plate, mesh etc. which have been metallurgically processed to contain a 'special' grain boundary frequency of ≧50%. These special grain boundaries are described crystallographically as lying within $\Delta\theta \geqq 15°\Sigma^{-1/2}$ of specific CSL descriptions having $\Sigma \geqq 29$; their enhanced frequency in the microstructure yields electrowinning anodes possessing superior resistance to intergranular corrosion in sulfuric acid-based electrowinning solutions. Such anodes are obtained by a process of selective and repetitive recrystallization, whereby cast of wrought starting stock of commercially pure Pb or of common electrowinning electrode material, is sequentially deformed (e.g., rolling, pressing, stamping, extruding, drawing etc.) and heat treated to induce recrystallization. The process of deformation and heat treatment being repeated at least once. Both commercially pure Pb and common Pb-based electrowinning electrode alloys can be so processed using deformations in the range of 30%–80% and heat treatment temperatures in the range of 180 C.–300 C. for 5 to 20 minutes, and sufficient to induce recrystallization.

Figure 1:
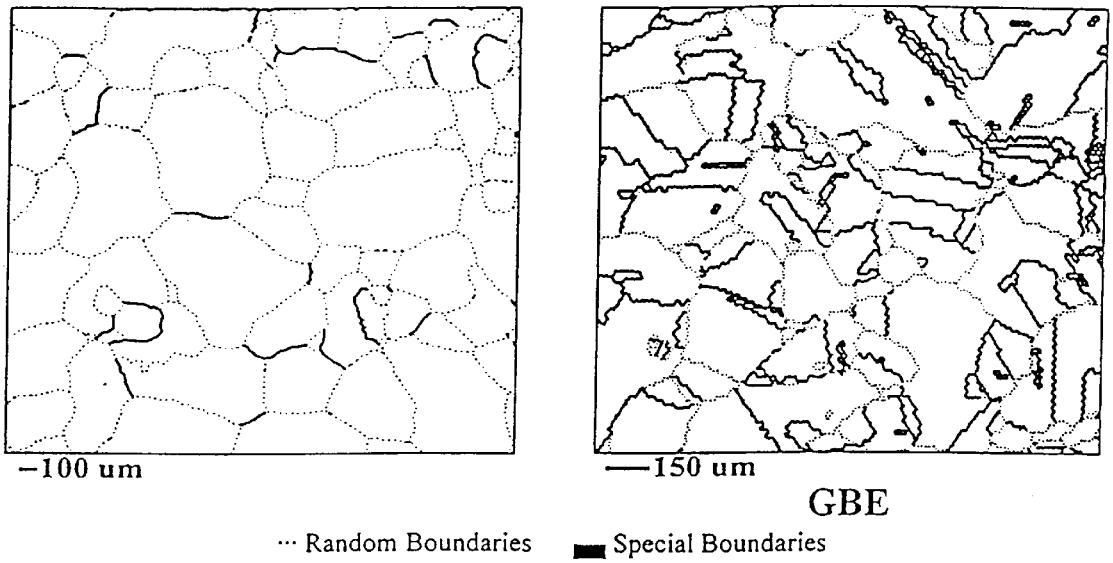
FIG. 1 is a graphic reproduction of crystallographic orientation images of Pb-Ag electrowinning material in (a) the conventional 'cast' condition and (b) after processing according to the method of the present invention.

FIG. 1 shows the grain boundary structure distributions for a Pb-0.1% Ag alloy in both the conventional cast condition, and following reprocessing in accordance with the embodiments of this invention. As shown in this figure, common as-cast material possesses 'special' grain boundary populations of 6%–8%; reprocessing, as described herein yields a 'special' grain boundary frequency of >60%.

Figure 2:
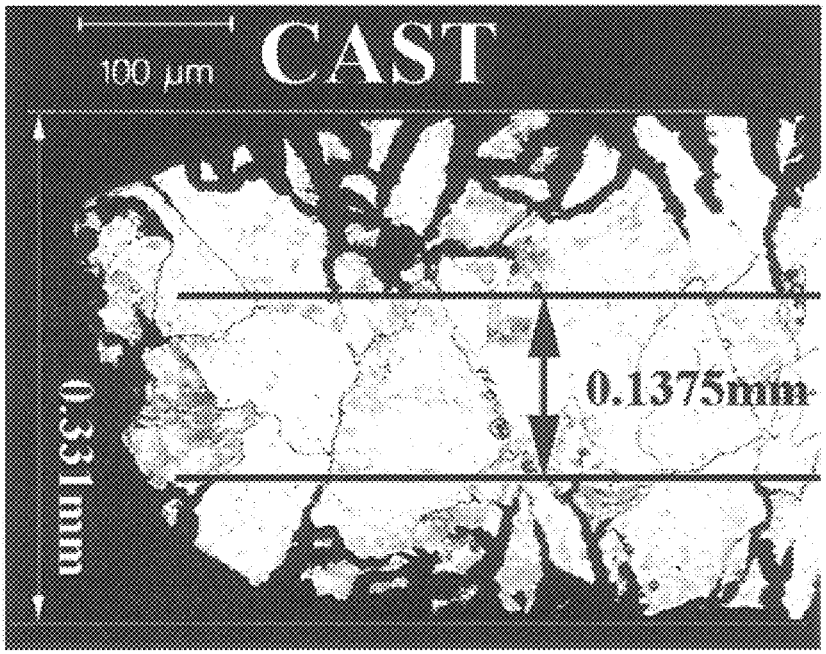
FIG. 2 is a reproduction of cross-sectional optical photomicrographs of intergranular corrosion on a Pb-Ag electrowinning alloy (a) in the as-cast conventional condition and (b) as-processed by the method of the present invention, each following 4 weeks of potentiostatic anodic polarization in sulfuric acid at a potential of 1.74V.
Figure 2:
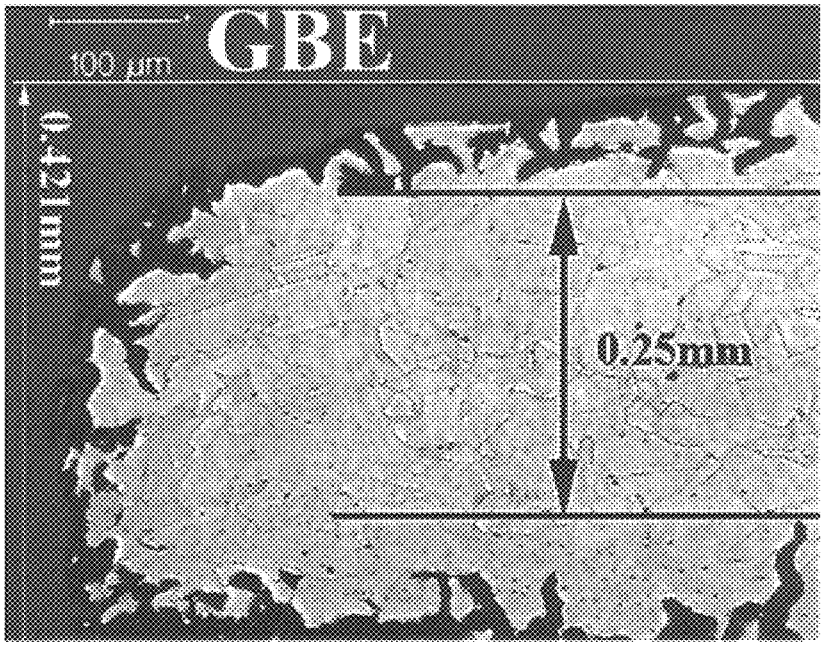
Figure 3:
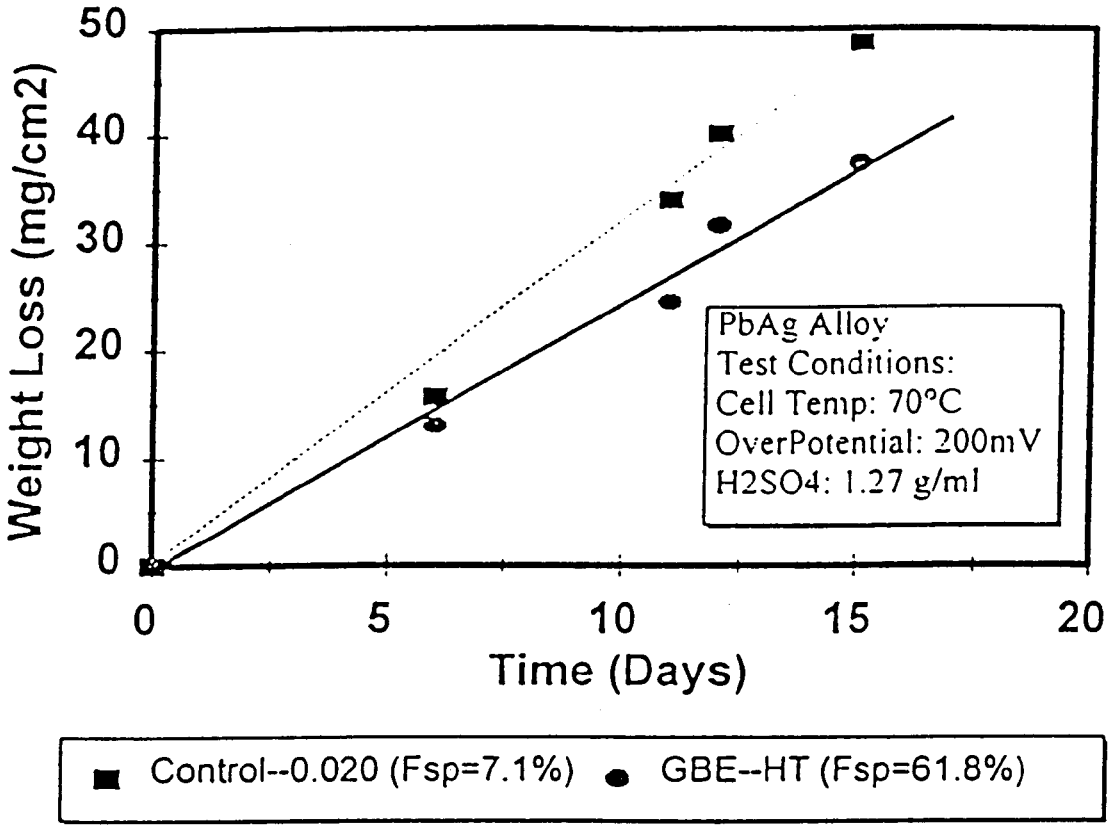
FIG. 3 is a graph of data, comparing the rate of weight loss sustained by a Pb-Ag electrowinning electrode material (a) in the conventional cast condition and (b) as-processed by the method of the present invention, during 4 weeks of potentiostatic anodic polarization in sulfuric acid at a potential of 1.74V d.c.

FIGS. 2 and 3 underscore the benefits in terms of intergranular corrosion and 'electrode-loss' which can be obtained by reprocessing in accordance with the embodiments of this invention.

The noted improvements in intergranular corrosion resistance will (1) significantly extend the service life of Pb-based electrode material (2) allow the use of thinner electrodes per electrowinning cell, and (3) allow the synthesis of higher purity metals from electrowinning operations.

We claim:

1. A method for processing a Pb-based alloy electrowinning electrode material to produce a microstructure containing at least a 50% level of special grain boundaries, comprising the steps of.

(i) subjecting the material to a cold deformation treatment to achieve a thickness reduction of from 30% to 80%;

(ii) annealing the material at a temperature in the range of 180 to 300° C. for 15 to 30 minutes to induce complete recrystallization; and (iii) carrying out at least one repetition of steps (i) and (ii).

2. A method according to claim 1, wherein said electrode material is a Pb-0.1% Ag alloy.

3. A corrosion-resistant electrowinning electrode fabricated of an electrode material produced by the method of claim 2.

* * * * *